US009227313B2

(12) United States Patent
Tseng

(10) Patent No.: US 9,227,313 B2
(45) Date of Patent: Jan. 5, 2016

(54) OPERATION MODE SWITCHING MECHANISM

(71) Applicant: Power Network Industry Co., Ltd., Ping-Jen, Taoyuan County (TW)

(72) Inventor: Lung-Hsuan Tseng, Zhongli (TW)

(73) Assignee: POWER NETWORK INDUSTRY CO., LTD., Ping-Jen (TW)

( * ) Notice: Subject to any disclaimer, the term of this patent is extended or adjusted under 35 U.S.C. 154(b) by 559 days.

(21) Appl. No.: 13/686,280

(22) Filed: Nov. 27, 2012

(65) Prior Publication Data

US 2014/0144657 A1 May 29, 2014

(51) Int. Cl.

| | |
|---|---|
| ***B25D 16/00*** | (2006.01) |
| ***B25D 11/10*** | (2006.01) |
| *B25B 21/00* | (2006.01) |
| *B25F 5/00* | (2006.01) |

(52) U.S. Cl.

CPC ..... *B25D 16/006* (2013.01); *B25D 11/106* (2013.01); *B25D 2216/0023* (2013.01); *B25D 2216/0038* (2013.01)

(58) Field of Classification Search

CPC .... B25D 16/006; B25D 16/00; B25D 16/003; B25D 11/04; B25D 11/106; B25D 11/005; B25D 11/062; B25D 2211/003; B25D 2211/068; B25D 2211/064; B25D 2211/106; B25D 2211/061; B25D 2216/0038; B25D 2216/0023; B25D 2216/0015; B25D 2216/0046; B25D 2250/045; B25D 2250/165; B25D 2250/245; B25D 2250/221; B25B 21/00; B25B 21/02; B25B 21/026; B25B 21/023; B25B 23/141; B25B 23/14; B25B 23/1405; Y10T 74/18024; Y10T 74/18032; Y10T 74/18304; Y10T 74/1946

USPC ..... 173/48, 90, 126–133, 13, 104, 109, 173/114, 201, 203, 205, 211, 216, 217; 74/22 R, 22 A, 25, 56; 175/189, 195, 175/217

See application file for complete search history.

(56) References Cited

U.S. PATENT DOCUMENTS

| | | | | |
|---|---|---|---|---|
| 5,545,109 | A * | 8/1996 | Hayakawa | 477/178 |
| 2005/0194164 | A1* | 9/2005 | Saito et al. | 173/48 |
| 2007/0056756 | A1* | 3/2007 | Chung et al. | 173/48 |
| 2008/0167158 | A1* | 7/2008 | Chen | 475/298 |
| 2009/0101376 | A1* | 4/2009 | Walker et al. | 173/47 |
| 2010/0000749 | A1* | 1/2010 | Andel | 173/48 |
| 2010/0319945 | A1* | 12/2010 | Chen | 173/48 |
| 2011/0232930 | A1* | 9/2011 | Zhang et al. | 173/178 |

* cited by examiner

*Primary Examiner* — Hemant M Desai
*Assistant Examiner* — Valentin Neacsu
(74) *Attorney, Agent, or Firm* — Rabin & Berdo, P.C.

(57) ABSTRACT

An operation mode switching mechanism for use with a power tool disclosed in the present invention includes a torsion unit, a switching unit, a clutch member, a power output member and an output shaft, where the switching unit can be switched between three rotating positions and one impact position. When the switching unit is at one of the rotating positions (screw symbols), the output shaft is driven to rotate by a carrier plate; and when switching unit is switched to the impact position (impact symbol), the output shaft is pushed by the clutch member so as to disengage from the carrier plate and is driven by a planet plate. The clutch member also restricts the direction of motion of the output shaft in the impact position, so the output shaft moves back and forward to generate reciprocating impact output.

6 Claims, 9 Drawing Sheets

OPERATION MODE SWITCHING MECHANISM

BACKGROUND OF THE INVENTION

1. Field of the Invention

The present invention relates to a mechanism for a power tool, more particularly to an operation mode switching mechanism, which can switch the operation mode between a rotating output position and an impact output position in a reciprocating manner.

2. The Prior Arts

A conventional power tool usually utilizes a gear system to transmit the power of a motor to an output shaft so as to achieve the function of variable output speed. In addition, in order to fasten a screw as tight as possible or to loosen an over-tightened screw, some power tools for drilling or screwing also have an impact function. With the impact function, the screws can be tightened during the tightening process, and the screws can be removed more easily during the loosening process as well. The impact function provided by the conventional power tools only provides impact in the rotational direction, which is useful during the tightening/loosening of a screw. However, the conventional power tool usually does not provide impact in the reciprocating manner.

SUMMARY OF THE INVENTION

The primary purpose of the present invention is to provide an operation mode switching mechanism for a power tool. With the switching mechanism of the present invention, the power tool can be switched to provide a reciprocating impact output in addition to the rotational output.

The operation mode switching mechanism provided by the present invention includes a torsion unit, a switching unit, a clutch member, a power output member and an output shaft, where the torsion unit can be switched between three rotating positions and an impact position. When the switching unit is at one of the rotating positions (screw symbols), the output shaft is driven to rotate by a carrier plate; and when switching unit is switched to the impact position (impact symbol), the output shaft is pushed by the clutch member so as to disengage from the carrier plate and is driven by a planet plate. The clutch member also restricts the direction of motion of the output shaft in the impact position, so the output shaft moves back and forward along an axial direction of the output shaft to generate reciprocating impact output.

The operation mode switching mechanism for a power tool, includes: a torsion unit; an output shaft having one end formed with a first recess and a vibrating block disposed in said first recess; a switching unit sleeved around the torsion unit, wherein the switching unit includes a function ring; a clutch member disposed within the torsion unit and including a mounting disk, a switch ring mounted on the mounting disk, a spring disposed within the switch ring and a connecting shaft that extends into the switch ring and that has a first end formed with a second recess for sleeving onto the output shaft and the other end formed with a through hole in spatial communication with the second recess; a power output member disposed within the torsion unit adjacent to the clutch member, the power output member including a carrier plate, a planet plate and a plurality of planet gears located between the carrier plate and the planet plate in such a manner that the planet gears are mounted rotatably on the carrier plate and simultaneously mesh with the planet plate, the planet plate having a pressing shaft extending from a center portion through the carrier plate into the second recess in the connecting shaft, thereby coupling the planet plate with the connecting shaft due to compression action of the spring.

The switching unit of the present invention can be switched between three rotating positions and an impact position. When the switching unit is switched to the rotating positions (screw symbols), the connecting shaft extends through an opening in the carrier plate such that the output shaft is driven to rotate by the carrier plate. When the switching unit is switched to the impact position (impact symbol), the switching unit pushes the switch ring via a pushing pin such that the connecting shaft disengages from the opening in the carrier plate due to restoration force of the spring.

An end of the connecting shaft of the abovementioned clutch member has an annular flange with an inclined surface. In the present invention, the inner peripheral portion of the switch ring complements with the inclined surface of the flange in such way that when the switching unit pushes the switch ring via the pushing pin, the inner peripheral portion of the switch ring pushes the inclined surface of the flange so as to push the connecting shaft in an axial direction further away from the carrier plate, thereby disengaging one end of the connecting shaft from the opening of the carrier plate.

In addition, a bearing washer is inserted inside an inner portion of said function ring and while a torsion case is mounted on an outer portion of said function ring. When the user rotates the function ring, the bearing washer is also rotated around the function ring and pushes the pushing pin inward. Furthermore, an end face of the pressing shaft is an inclined surface or a ratchet in order to complement with the vibrating block in the output shaft.

DETAILED DESCRIPTION OF THE PREFERRED EMBODIMENTS

The present invention will be apparent to those skilled in the art by reading the following detailed description of preferred embodiments thereof, with reference to the attached drawings.

Figure 1:
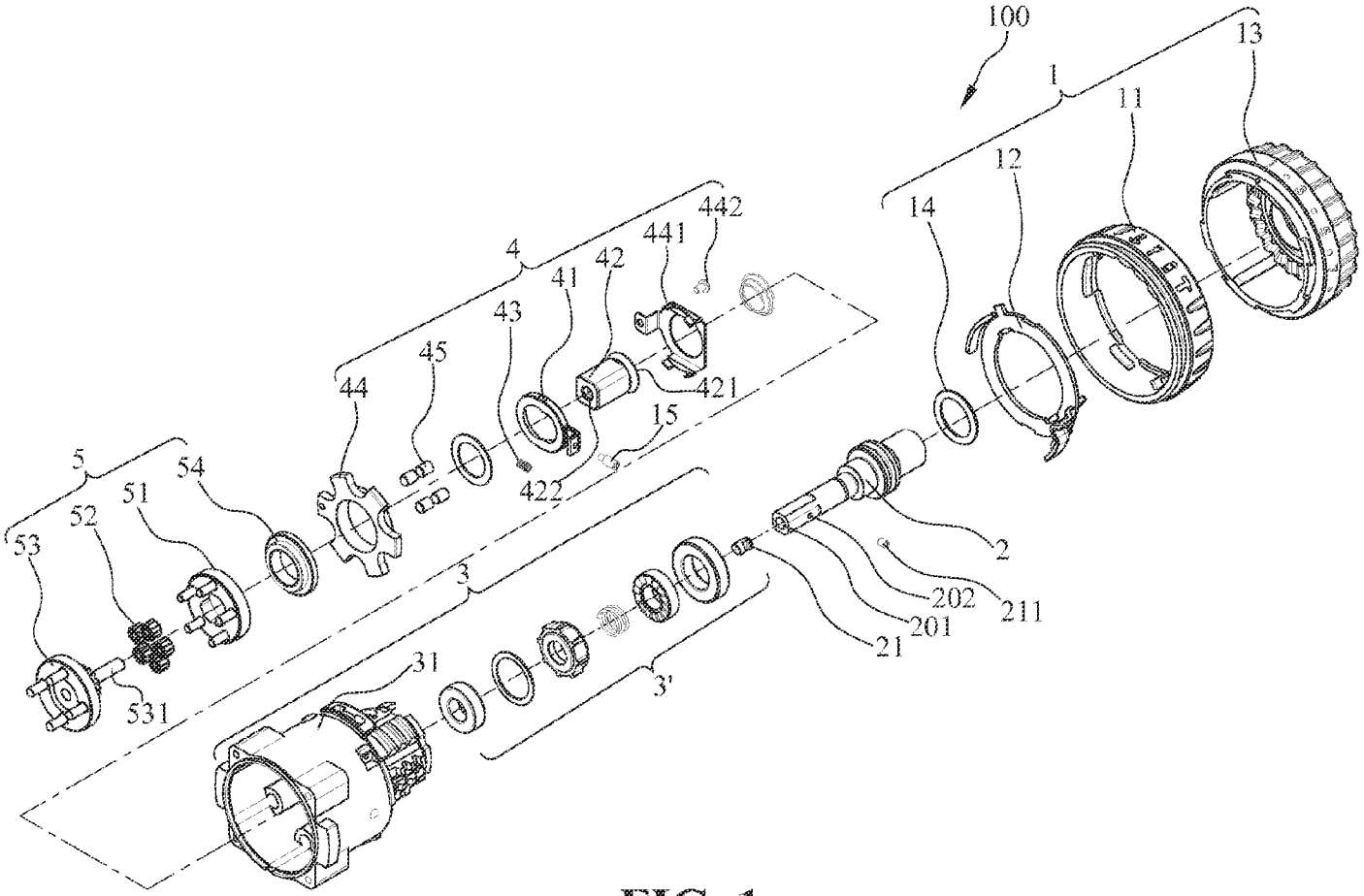
FIG. 1 is an exploded view showing a preferred embodiment of the operation mode switching mechanism of the present invention.

FIG. 1 is an exploded view showing a preferred embodiment of the operation mode switching mechanism of the present invention for a power tool 100. As shown in FIG. 1, the operation mode switching mechanism of the present invention includes: a switching unit 1, an output shaft 2, a torsion unit 3, a clutch member 4 and a power output member 5. The torsion unit 3 includes a casing 31 and a plurality of torsion members 3' used mainly for enclosing and mounting the parts of the power tool 100. The torsion unit 3 also provides torque to the power tool 100 to enable the power tool 100 to rotate.

The switching unit 1 has a function ring 11 connected with the casing 31, where one end of the function ring 11 is connected to a torsion case 13, and the other end thereof is inserted with a bearing washer 12 inside. On the other hand, one end of the output shaft 2 is inserted into the torsion unit 3, and the other end is exposed outside the power tool 100 through the torsion case 13. In this preferred embodiment, an O-ring 14 is sleeved around the output shaft 2 so as to be disposed between the output shaft 2 and the switching unit 1, and a first recess 201 is formed at an end of the output shaft 2, which is inside the power tool 100. In addition, a radial screw hole 202 is formed at a side face of the output shaft 2 in such way that the screw hole 202 is in spatial communication with the first recess 201, and a vibrating block 21 is installed in the first recess 201 through a screw 211 via the screw hole 202.

The clutch member 4 is installed in the casing 31, includes a switch ring 41, a connecting shaft 42 and a mounting disk 44, where the switch ring 41 is mounted on the mounting disk 44 and a spring 43 is disposed inside the switch ring 41. In this preferred embodiment, the switch ring 41 is sandwiched between a mounting plate 441 and the mounting disk 44, and is fastened by a mounting screw 442. The connecting shaft 42 of the clutch member 4 is inserted into the switch ring 41, and a plurality of locking pins 45 are placed between the outer diameter of the connecting shaft 42 and the inner diameter of the mounting disk 44. In addition, a second recess 421 is formed at the center of an end of the connecting shaft 42 for sleeving onto the output shaft 2, and a through hole 422 formed at the other end thereof is in spatial communication with the second recess 421.

The power output member 5 is installed inside the casing 31, and is located adjacent to the clutch member 4. The power output member 5 includes a carrier plate 51, a plurality of planet gears 52 and a planet plate 53, where a pressing shaft 531 extends outward from a center of the planet plate 53. The planet gears 52 are located between the carrier plate 51 and the planet plate 53 in such a manner that the planet gears 52 are mounted rotatably on the carrier plate 51 while meshing with the planet plate 53. In addition, a positioning ring 54 is disposed between the mounting disk 44 of the clutch member 4 and the carrier plate 51.

Figure 2B:
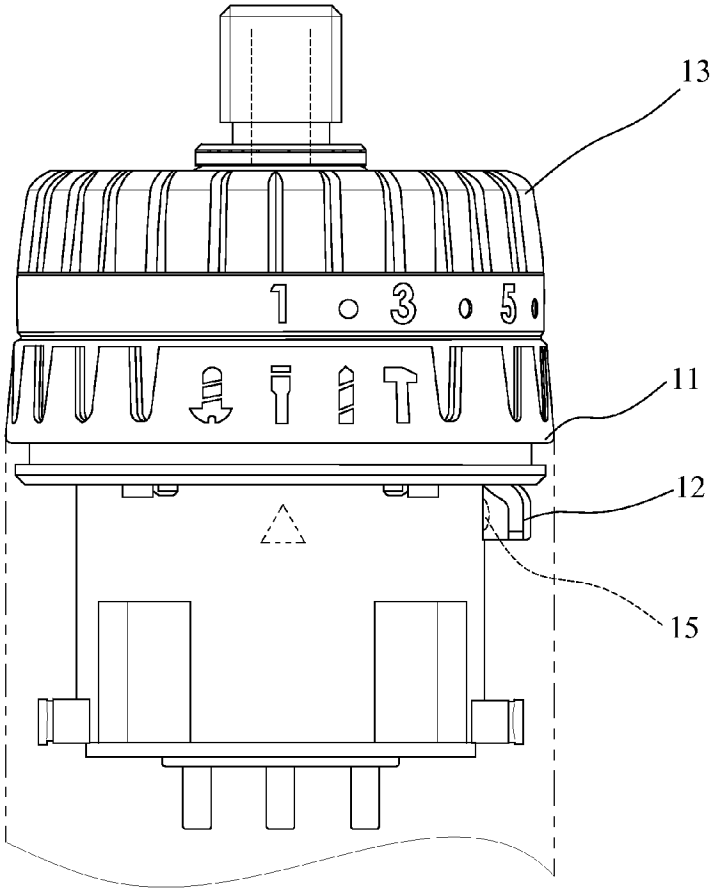
FIG. 2B is a schematic view showing the operation mode switching mechanism of the present invention at a impact position (impact symbol)
Figure 2A:
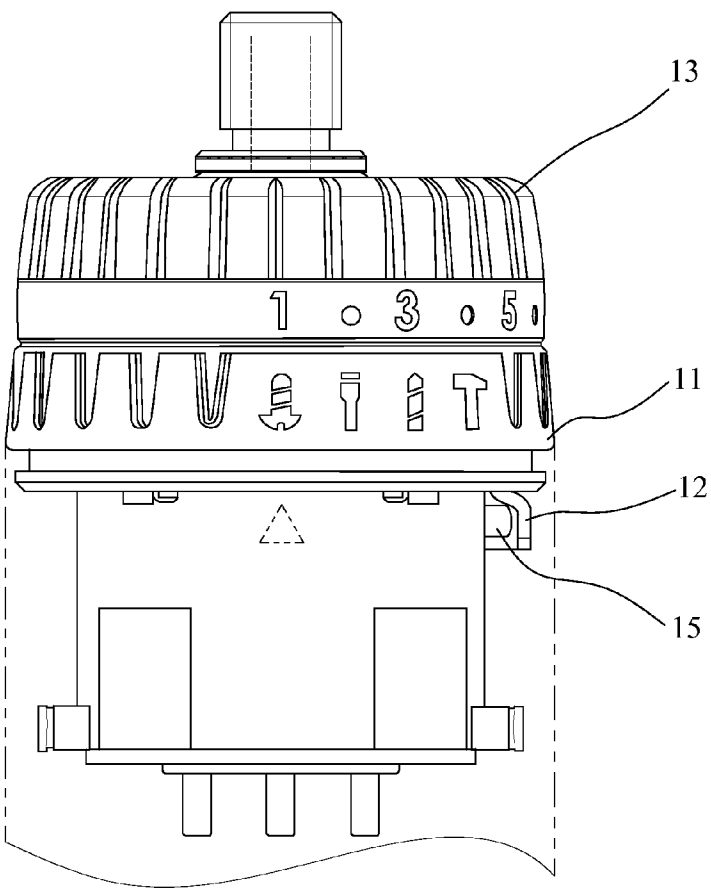
FIG. 2A is a schematic view showing the operation mode switching mechanism of the present invention at a rotating position (screw symbol)
Figure 4:
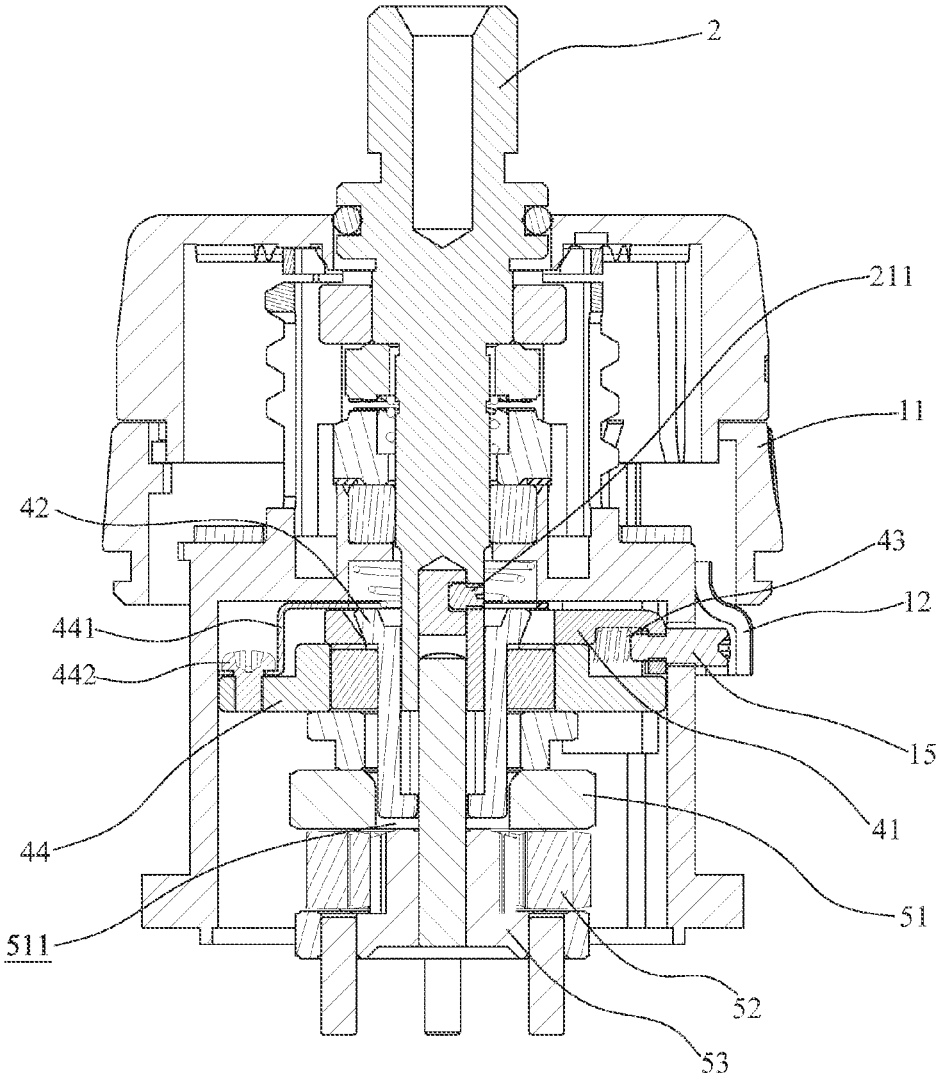
FIG. 4 is a cross-section view showing the operation mode switching mechanism of the present invention at the rotating position taken along the line B-B' in FIG. 3.
Figure 6:
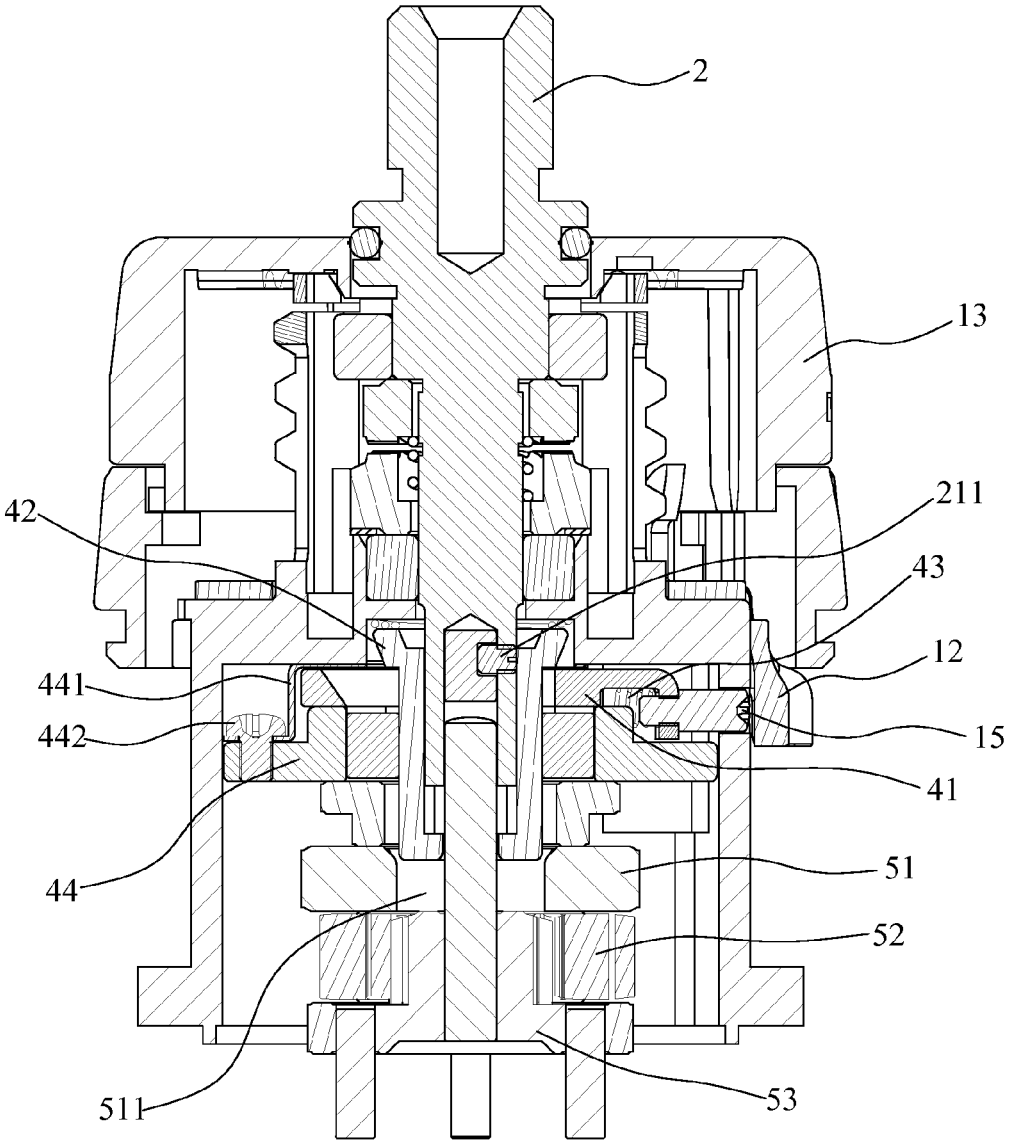
FIG. 6 is a cross-section view showing the operation mode switching mechanism of the present invention at the impact position taken along the line B-B' in FIG. 3.

FIG. 2A is a schematic view showing the operation mode switching mechanism of the present invention at a rotating position (screw symbol) and FIG. 2B is a schematic view showing the operation mode switching mechanism of the present invention at an impact position (impact symbol). As shown in FIGS. 2A and 2B, there are symbols marked on the function ring 11 and the torsion case 13. In this preferred embodiment, the user can rotate the function ring 11 to align one of the symbols of three rotating positions (screw symbols) or the impact position (impact symbol) to an indication marked on a housing (as the triangle shape hidden lines shown in FIG. 2A and FIG. 2B) of the power tool 100 to switch the operation mode, the user also can rotate the torsion case 13 to align one of the torsion symbols of 1, 3, 5 and dots marked on the torsion case 13 with the indication for adjusting the torsion of the power tool. As shown in FIG. 2A and FIG. 4, a pushing pin 15 is exposed to an exterior of the casing 31 of the torsion unit 3 at the rotating position. On the other hand, when the function ring 11 is rotated to the impact position as shown in FIG. 6, the bearing washer 12 is also rotated to push the exposed pushing pin 15 inward. When the pushing pin 15 is pushed inside the power tool 100, the operation mode switching mechanism is activated to switch the operation mode from rotational drive to reciprocating impact drive. The action of the operation mode switching mechanism will be described in detail in the following description.

Figure 3:
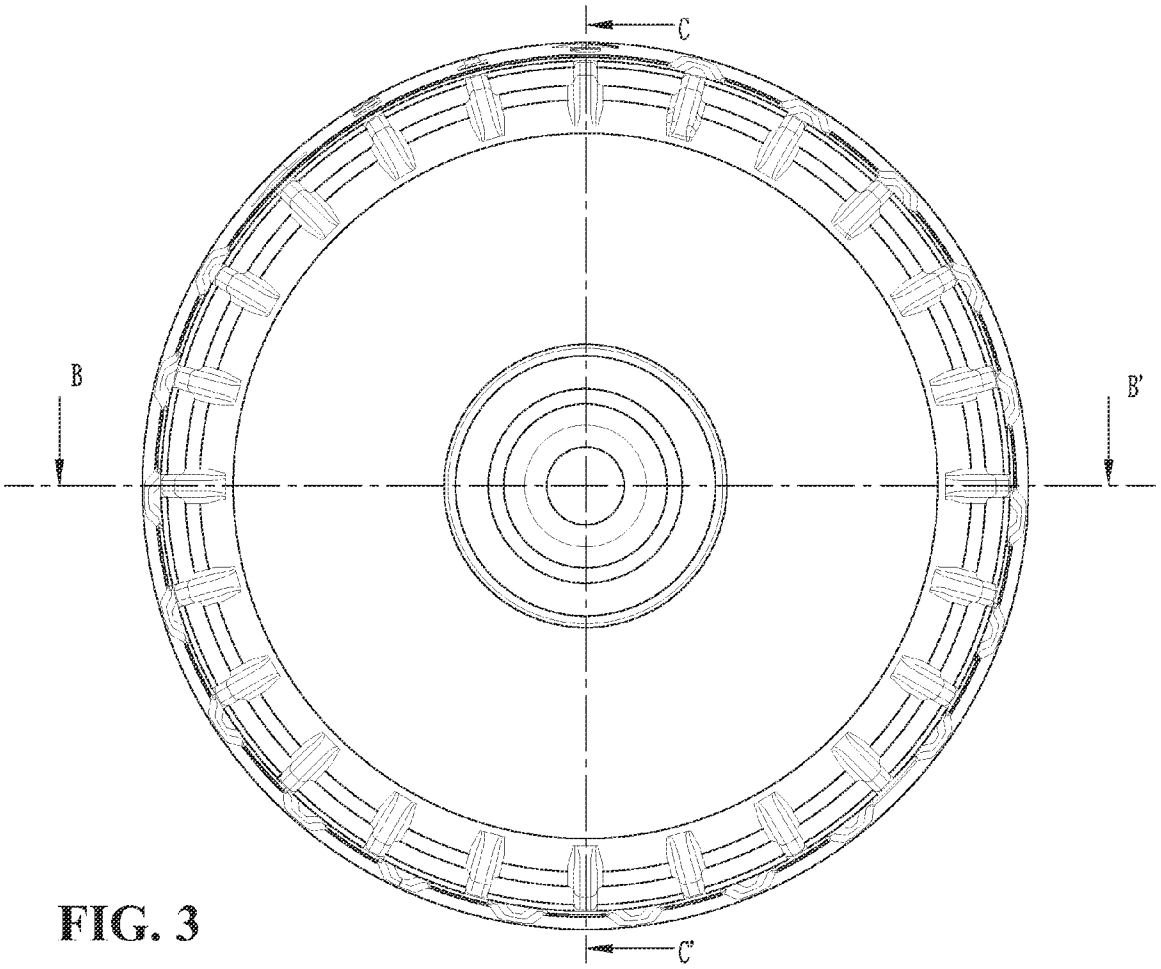
FIG. 3 is a top view showing the position of the B-B' and C-C' sections of the operation mode switching mechanism of the present invention.
Figure 5:
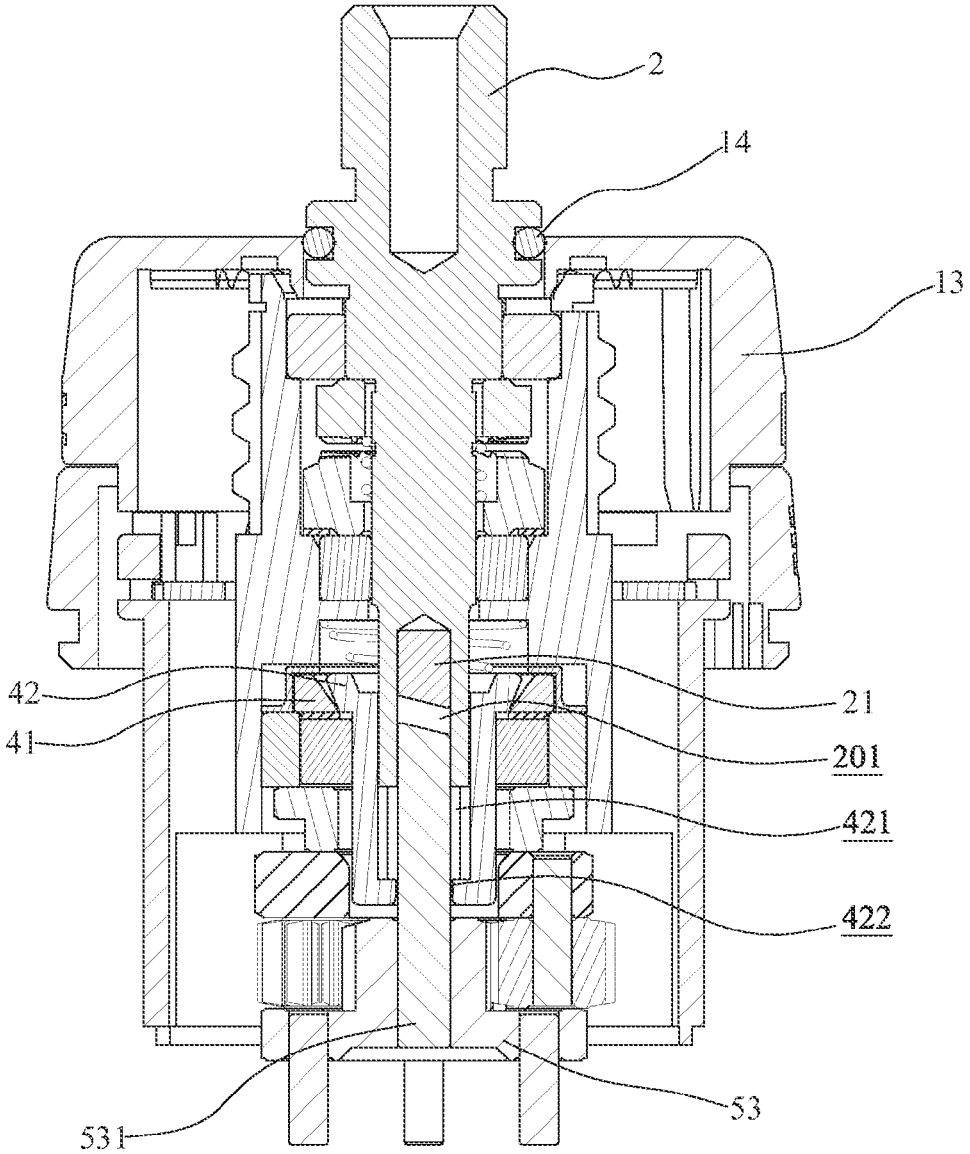
FIG. 5 is a cross-section view showing the operation mode switching mechanism of the present invention at the rotating position taken along the line C-C' in FIG. 3.

FIG. 3 is a top view showing the position of the B-B' and C-C' section of the operation mode switching mechanism of the present invention, FIG. 4 is a cross-section view showing the operation mode switching mechanism of the present invention at the rotating position taken along the line B-B' in FIG. 3; and FIG. 5 is a cross-section view showing the operation mode switching mechanism of the present invention at the rotating position taken along the line C-C' in FIG. 3. As shown in FIGS. 4 and 5, the connecting shaft 42 is engaged from the opening 511 in the carrier plate 51, so the power can be transmitted from the carrier plate 51 to the output shaft 2 via the connecting shaft 42 to rotate the output shaft 2. Notably, the spring 43 between the connecting shaft 42 and the mounting disk 44 remains at a non-compressed state; also, although the pressing shaft 531 extends into the first recess 201 of the output shaft 2, the pressing shaft 531 is not in contact with the vibrating block 21.

Figure 7:
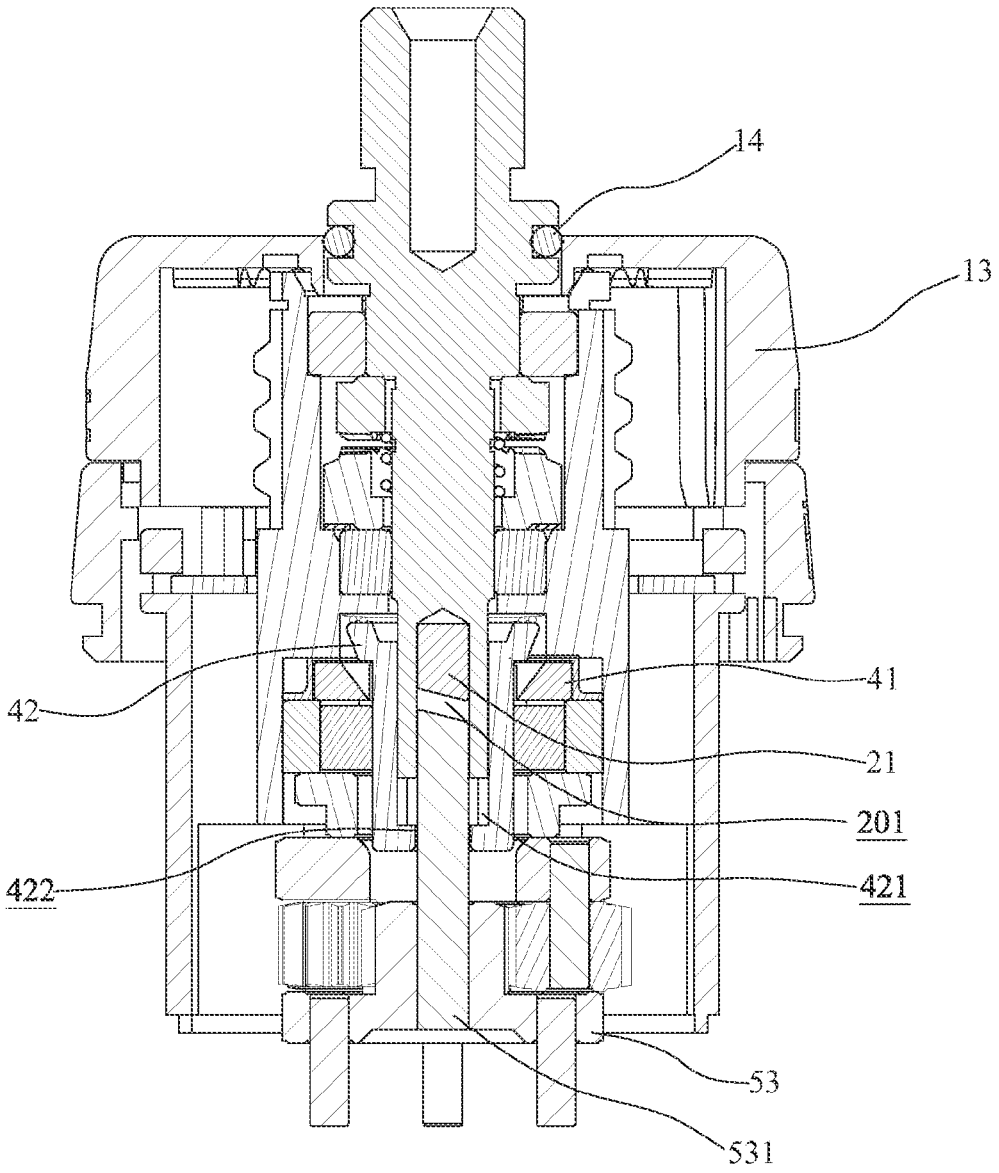
FIG. 7 is a cross-section view showing the operation mode switching mechanism of the present invention at the impact position taken along the line C-C' in FIG. 3.

FIG. 6 is a cross-section view showing the operation mode switching mechanism of the present invention at the impact position taken along the line B-B' in FIG. 3. FIG. 7 is a cross-section view showing the operation mode switching mechanism of the present invention at the impact position taken along the line C-C' in FIG. 3. As shown in FIGS. 6 and 7, when the user switches the function ring 11 from the rotating position of FIG. 2A (screw symbol) to the impact position of FIG. 2B (impact figure), the pushing pin 15 exposed to an exterior of the casing 31 is pushed inward by the bearing washer 12, and then the pushing pin 15 further pushes the switch ring 41, which is adjacent to the pushing pin 15. When the switch ring 41 is pushed inward, the spring 43 becomes compressed and the connecting shaft 42 is lifted in the upward direction in FIGS. 6 and 7, which in turn causes the end of the connecting shaft 42 to disengage from the opening 511 in the carrier plate 51. After the disengagement of the connecting shaft 42 from the carrier plate 51, rotational power is no longer provided to the output shaft 2 from the carrier plate 51. Therefore the output shaft 2 no longer rotates. The switch ring 41 not only disengages the connecting shaft 42 from the carrier plate 51, it also restricts the direction of motion of the connecting shaft 42, so the connecting shaft only moves in the axial direction thereof.

Figures 8A, 8B:
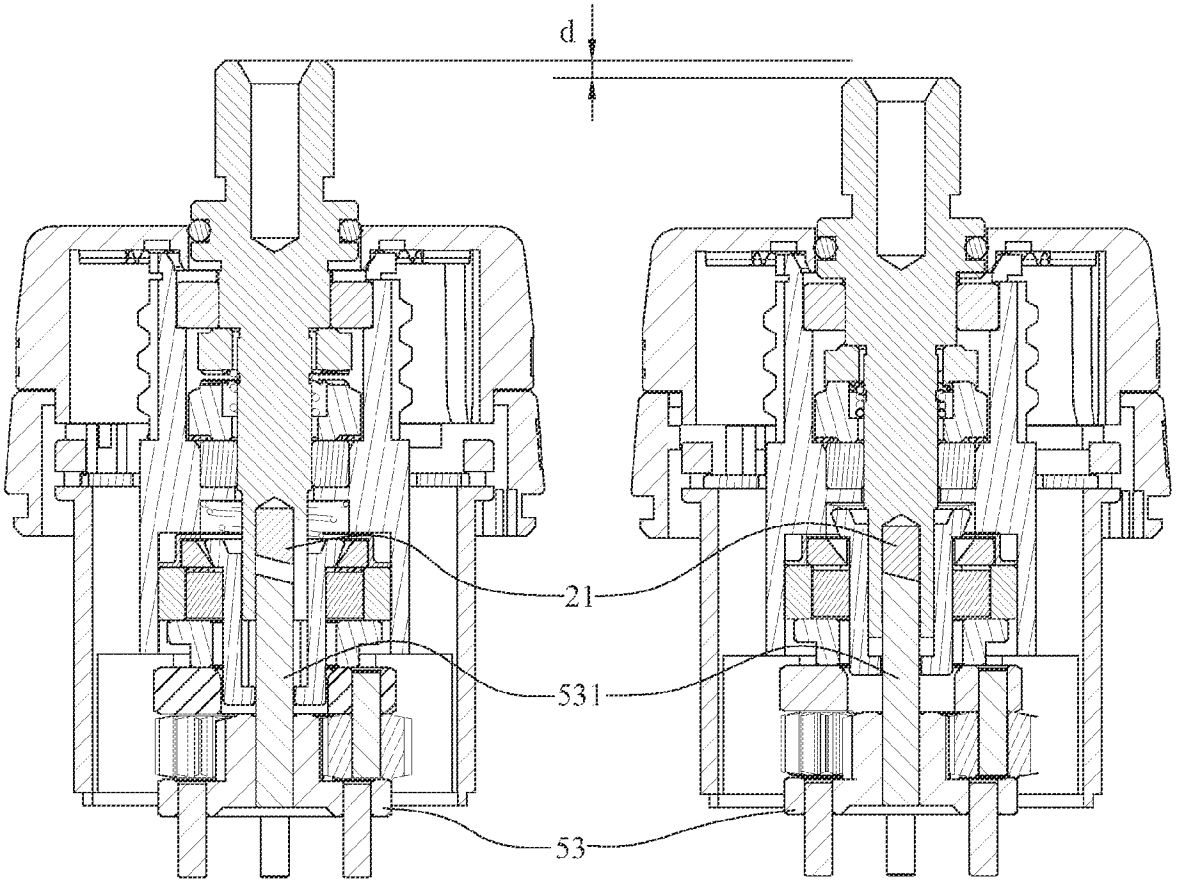
FIGS. 8A and 8B are schematic views showing the impact motion of the operation mode switching mechanism at the impact position.

In addition, in order to let the output shaft 2 and the connecting shaft 42 to move along the axial direction, the power is provided by the carrier plate 51 through the planet gears 52 to the pressing shaft 531 of the planet plate 53. However, as shown in FIG. 8A, even though the connecting shaft 42 is disengaged from the carrier plate 51, the vibrating block 21 of the output shaft 2 is still not in direct contact with the pressing shaft 531. In this preferred embodiment, the end face of the pressing shaft 531 is designed as an inclined surface or a ratchet, which complements with the vibrating block 21 of the output shaft 2. Hence, when the user presses the output shaft 2 downward for a distance d as shown in FIG. 8B, the vibrating block 21 contacts the pressing shaft 531. In this way, since the direction of motion of the connecting shaft 42 and the output shaft 2 have already been restricted by the switch ring 41, when the pressing shaft 531 rotates with the planet plate 53, the inclined surfaces/ratchet of the end face of the pressing shaft 531 and the vibrating block 21 push against each other, which causes the output shaft to move back and forward and generates a reciprocating impact output.

Notably, in this preferred embodiment of the present invention, a ratchet or an inclined surface is used for the vibrating block 21 and pressing shaft 531, however, any other forms or configuration which can produce a reciprocating effect are also included in the scope of the present invention.

Figure 9A:
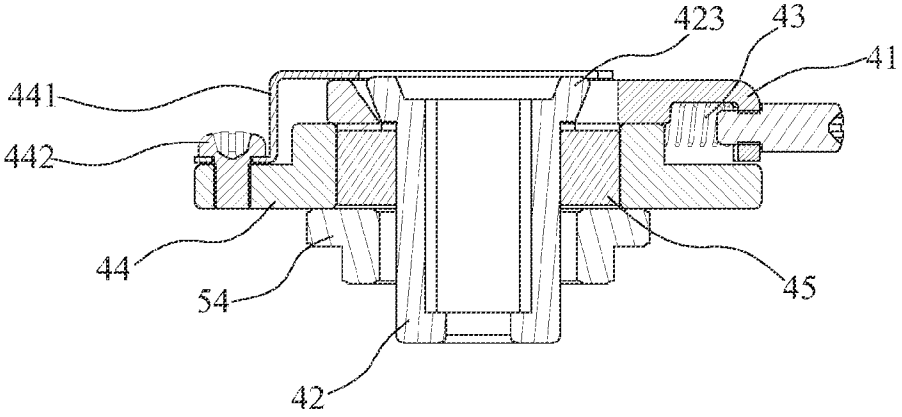
FIG. 9A is a partially enlarged view of the operation mode switching mechanism of the present invention at the rotating position.
Figure 9B:
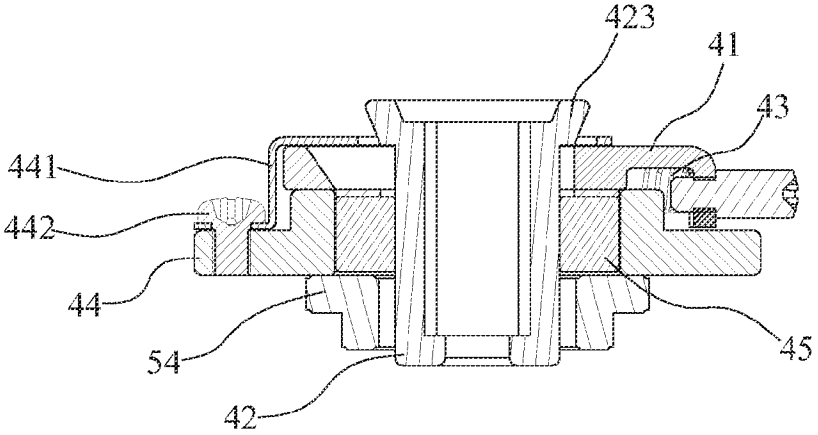
FIG. 9B is a partially enlarged view of the operation mode switching mechanism of the present invention at the impact position.

FIGS. 9A and 9B are partially enlarged views showing the operation mode switching mechanism of the present invention at the rotating position (screw symbol) and the impact position (impact symbol) respectively. In the preferred embodiment of the present invention, an annular flange 423 is disposed at an end of the connecting shaft 42 of the clutch member 4, where the flange 423 has an inclined surface. The inner peripheral portion of the switch ring 41 is configured to complement with the inclined surface of the flange 423, so that the inner peripheral portion switch ring 41 pushes the inclined surface of flange 423 when the clutch member 4 pushes the pushing pin 15 and the switch ring 41 inward. With the above configuration, the connecting shaft 42 is then pushed away from the carrier plate 51 in the axial direction, and the end of the connecting shaft 42 disengages from the opening 511 in the carrier plate 51.

The power tool 100 configured according to the preferred embodiment described above can be connected with a power tool casing and a motor at the torsion unit 3 to be provided with a power source. When the operation mode of the power tool 100 needs to be switched from reciprocating impact back to rotational output, the user can simply rotate the function ring 11 to the left or right, and the switch ring 41 will return to its initial position due to the restoration force of the spring 43. After the switch ring 41 has returned to its initial position, the connecting shaft 42 will also re-engage with the opening 511 in the carrier plate, thereby restoring the rotational output.

The preferred embodiments described above are disclosed for illustrative purpose. Thus, any modifications and variations made without departing from the spirit and scope of the invention should still be covered by the scope of this invention as disclosed in the accompanying claims.

What is claimed is:

1. An operation mode switching mechanism for a power tool, comprising:

a torsion unit;

an output shaft having one end formed with a first recess and a vibrating block disposed in said first recess;

a switching unit sleeved around said torsion unit, including a function ring;

a clutch member disposed within said torsion unit, said clutch member including a mounting disk, a switch ring mounted securely on said mounting disk, a spring disposed within said switch ring, and a connecting shaft that extends into said switch ring and that has a first end formed with a second recess for sleeving onto said output shaft and the other end formed with a through hole in spatial communication with said second recess; and a power output member disposed within said torsion unit adjacent to said clutch member, said power output member including a carrier plate, a planet plate and a plurality of planet gears located between said carrier plate and said planet plate in such a manner that said planet gears are mounted rotatably on said carrier plate and simultaneously mesh with said planet plate, said planet plate having a pressing shaft extending from a center portion through said carrier plate into said second recess in said connecting shaft, thereby coupling said planet plate with said connecting shaft due to compression action of said spring;

wherein, said switching unit can be switched between a rotating position, in which, said connecting shaft extends through an opening in said carrier plate so as to be driven to rotate by said carrier plate, and an impact position, in which, said switching unit pushes said switch ring via a pushing pin such that said connecting shaft disengages from said opening in said carrier plate due to a restoration force exerted by said spring.

2. The operation mode switching mechanism as claimed in claim 1, wherein an end of said connecting shaft has an annular flange with an inclined surface at one end thereof for pushing said connecting shaft away from said carrier plate in an axial direction of said connecting shaft when an inner peripheral portion of said switch ring abuts against said inclined surface of said flange.

3. The operation mode switching mechanism as claimed in claim 1, wherein a bearing washer is inserted inside an inner portion of said function ring while a torsion case is connected to said function ring.

4. The operation mode switching mechanism as claimed in claim 1, wherein said pushing pin is exposed to an exterior of said torsion unit.

5. The operation mode switching mechanism as claimed in claim 1, wherein an end face of said pressing shaft is an inclined surface or a ratchet in order to complement with said vibrating block in said output shaft.

6. The operation mode switching mechanism as claimed in claim 1, wherein said switch ring is mounted on the mounting disk through a mounting plate and a mounting screw.

* * * * *